US008031104B2

(12) United States Patent
Jänis

(10) Patent No.: US 8,031,104 B2
(45) Date of Patent: Oct. 4, 2011

(54) MICROWAVE ABSORBER, ESPECIALLY FOR HIGH TEMPERATURE APPLICATIONS

(75) Inventor: Anna Jänis, Åtvidaberg (SE)

(73) Assignee: Totalförsvarets Forskningsinstitut, Stockholm (SE)

( * ) Notice: Subject to any disclaimer, the term of this patent is extended or adjusted under 35 U.S.C. 154(b) by 0 days.

(21) Appl. No.: 12/311,937

(22) PCT Filed: Oct. 18, 2007

(86) PCT No.: PCT/SE2007/000918

§ 371 (c)(1),
(2), (4) Date: Dec. 16, 2009

(87) PCT Pub. No.: WO2008/051140

PCT Pub. Date: May 2, 2008

(65) Prior Publication Data

US 2010/0090879 A1 Apr. 15, 2010

(30) Foreign Application Priority Data

Oct. 19, 2006 (SE) ..... 0602197

(51) Int. Cl.
*H01Q 17/00* (2006.01)

(52) U.S. Cl. ..... 342/1; 342/2; 342/3; 342/4

(58) Field of Classification Search ..... 342/1–4
See application file for complete search history.

(56) References Cited

U.S. PATENT DOCUMENTS

| | | | | |
|---|---|---|---|---|
| 3,938,152 | A * | 2/1976 | Grimes et al. | 342/1 |
| 4,012,738 | A * | 3/1977 | Wright | 342/1 |
| 4,038,660 | A * | 7/1977 | Connolly et al. | 342/1 |
| 4,084,161 | A * | 4/1978 | Manning et al. | 342/2 |
| 5,214,432 | A * | 5/1993 | Kasevich et al. | 342/3 |
| 5,537,116 | A * | 7/1996 | Ishino et al. | 342/1 |
| 5,627,541 | A * | 5/1997 | Haley et al. | 342/1 |
| 6,043,769 | A * | 3/2000 | Rowe et al. | 342/4 |
| 6,756,931 | B2 * | 6/2004 | Mukasa et al. | 342/1 |
| 6,867,725 | B2 * | 3/2005 | Breeden et al. | 342/1 |
| 7,067,203 | B2 * | 6/2006 | Joelsson et al. | 428/697 |
| 2004/0257260 | A1 * | 12/2004 | Breeden et al. | 342/1 |

FOREIGN PATENT DOCUMENTS

| | | | |
|---|---|---|---|
| EP | 0 677 888 | A1 | 10/1995 |
| EP | 1 378 304 | A2 | 1/2004 |
| WO | WO 2004/091049 | A1 | 10/2004 |

OTHER PUBLICATIONS

"The MAX Phases: Unique New Carbide and Nitride Materials", Barsoum, Michael W., Tamer El-Raghy, American Scientist, vol. 89, Jul.-Aug. 2001, pp. 334-343.*

* cited by examiner

*Primary Examiner* — Thomas Tarcza
*Assistant Examiner* — Peter Bythrow
(74) *Attorney, Agent, or Firm* — Jacobson Holman PLLC

(57) ABSTRACT

A microwave absorber, especially for high temperature applications, has at least one resistive sheet and at least one dielectric layer. The resistive sheet has a material of construction that is a MAX phase material.

10 Claims, 6 Drawing Sheets

MICROWAVE ABSORBER, ESPECIALLY FOR HIGH TEMPERATURE APPLICATIONS

CROSS-REFERENCE TO RELATED APPLICATION

This is a national stage of PCT/SE07/000918 filed Oct. 18, 2007 and published in English, which has a priority of Sweden no. 0602197-6 filed Oct. 19, 2006, hereby incorporated by reference.

BACKGROUND OF THE INVENTION

1. Field of Invention

The present invention relates to a radiation absorber in the microwave field. It is known to coat surfaces reflecting radar radiation with different types of radar absorber. Most radar absorbers currently have a layer structure. There are those using one or more thin resistive sheets with an appropriate surface resistance. Prior art absorbers of this type are Salisbury screens, Jaumann absorbers and single foil layers.

2. Description of the Prior Art

A Salisbury screen consists of a resistive sheet which is placed at a distance of a quarter of a wavelength from a metal surface. The resistive sheet has the same surface resistance as the wave impedance in vacuum and the intermediate layer is a dielectric layer with the dielectric constant near 1. A Jaumann absorber is a combination of two or more Salisbury screens. A single foil layer consists of two dielectric layers with an intermediate resistive sheet. It is well known how the various prior art radar absorbers are to be built in respect of surface resistance of resistive sheets, relative dielectric constant of dielectric layers and thickness of the layers included for the radar absorber to function according to requirements.

The surface resistance of the resistive sheet, the relative dielectric constant of the distance material and the thickness of various layers are due to the frequency range in which the structure is optimised and the degree of reflection that is desired, that is due to the demands placed on the absorber. One example of a single foil layer optimised for the X and P band is illustrated in FIG. 1*a*. The surface resistance of the resistive sheet is 125Ω/□. The two layers of distance material are dielectric materials with a relative dielectric constant $\in_r=4$ and a thickness of 3 mm. FIG. 1*b* shows the measured reflection in the frequency range 0-20 GHz from the radar absorber in FIG. 1*a*. The absorber has a reflection less than −13 dB (5%) in the frequency range 7.4-17.7 GHz.

Resistive sheets in radar absorbers that are currently used are often made of carbon fibre cloth or a plastic film with a thin lossy sheet. These materials function at room temperature and neighbouring temperatures. However, they cannot be used at significantly higher temperatures since they would then be destroyed. It is, however, very important to be able to produce a radar absorber which can be applied to hot surfaces, such as the outlet of a jet engine or a rocket engine. This has not been possible with prior art radar absorbers.

SUMMARY OF THE INVENTION

The present invention provides a solution to this problem by the invention being designed as described herein. Various advantageous embodiments of the invention are as described herein. The invention is, of course, also useful in traditional applications at lower temperatures.

BRIEF DESCRIPTION OF THE DRAWINGS

The invention will in the following be described in more detail with reference to the accompanying drawings, on which

DETAILED DESCRIPTION OF THE PREFERRED EMBODIMENTS

Figure 1A:
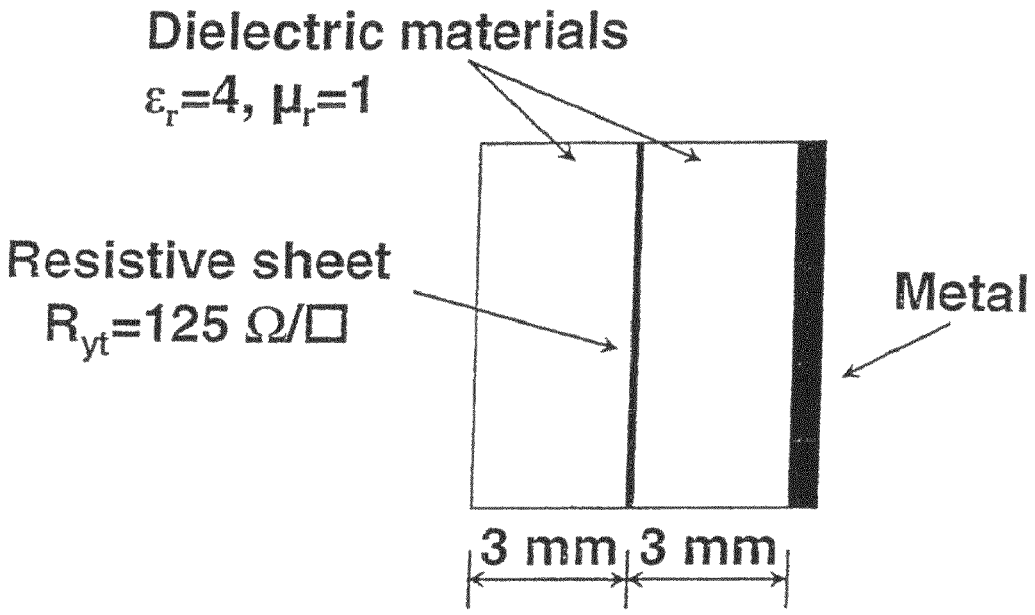
Fig. 1a PRIOR ART
FIG. 1*a* shows an example of the structure of a single foil layer.
Figure 1B:
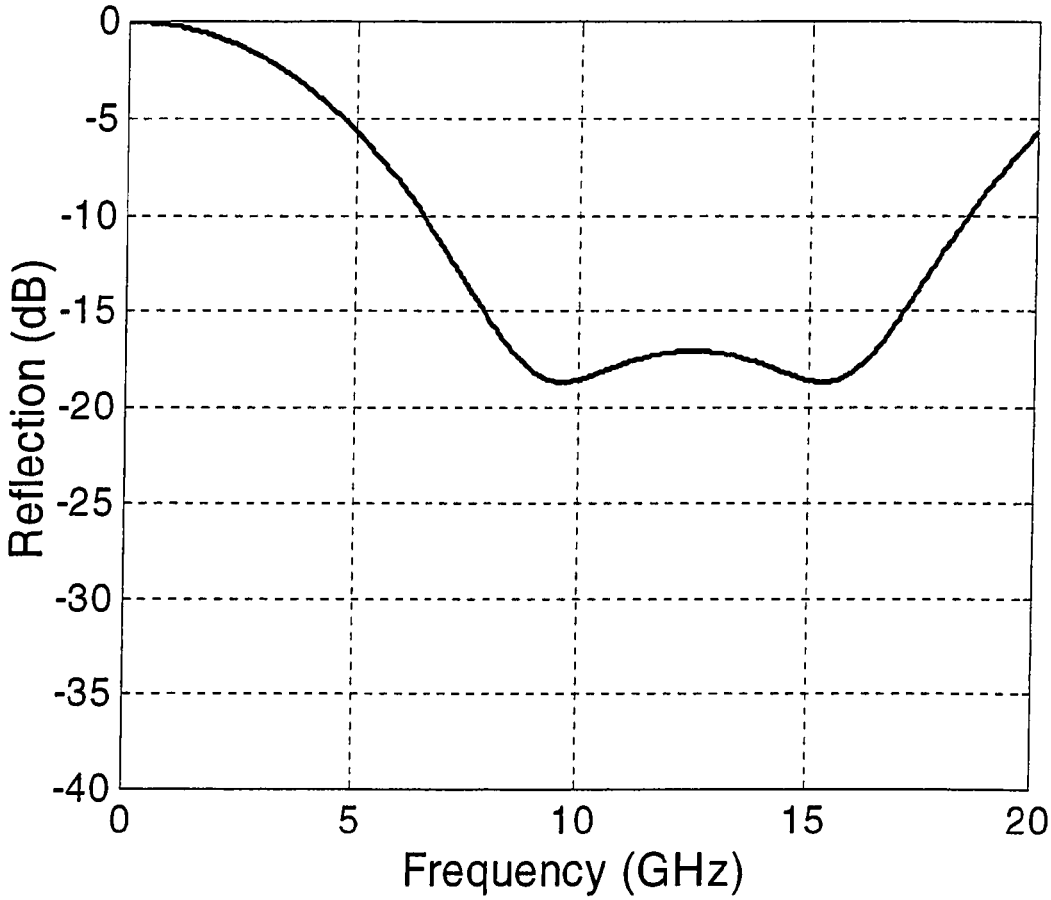
FIG. 1*b* is a diagram of the radiation absorbing ability of the single foil layer in FIG. 1*a*.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the invention, one starts, due to the application, from a radar absorber of some known type, in which the traditional resistive sheet or the traditional resistive sheets are replaced by sheets made of a MAX phase material. Such materials resist high temperatures, see the further discussion of these materials below. Moreover, dielectric layers included are made of a temperature resistant material with appropriate electrical properties. These materials are here referred to as low permittivity ceramics (relative dielectric constant $\in_r<15$), all materials that are inorganic and not metals being called ceramics.

This means that also different types of glass are included in the ceramics. There are those that resist high temperatures. In Table 1 below there are a few examples of low permittivity ceramics and their dielectric constant. Also ceramic composites, (particle, whiskers and fibre reinforced ceramic composites) can be used as dielectric layers provided they have an appropriate dielectric constant.

TABLE 1

| Material | Dielectric constant $\epsilon_r$ |
|---|---|
| Steatite, $Mg_3Si_4O_{10}(OH)_2$ | 6.0-6.1 |
| Cordierite, $Mg_2A_{14}Si_5O_{18}$ | 5.0-5.7 |
| Forsterite, $2MgO•SiO_2$ | 6.4 |
| Mullite, $Al_6Si_2O_{13}$ | 6.7-7.5 |
| Aluminium oxide, $Al_2O_3$ | 9.5-9.7 |
| Beryllium oxide, BeO | 6.5-6.8 |
| Aluminium nitride, AlN | 8.8-8.9 |
| Silicon nitride, $Si_3N_4$ | 8.1 |
| Quartz glass, $SiO_2$ glass | 3.8 |

When needed, the dielectric constant of ceramics can be reduced by pores being introduced in the material. The dielectric constant can also be reduced by production of composites. For mullite, it is possible to produce, for example, composites of mullite and quartz glass or mullite and cordierite.

Regarding the resistive sheet, it is demonstrated in the following that a MAX phase material can, in terms of the electromagnetic properties, function in the same way as resistive sheets used up to now. When producing a radar absorber, a technique that is known from the radiation absorption point of view is therefore used, and a person skilled in the art calculates, in the traditional way, desirable electromagnetic properties of the layers included, based on requirements.

The special feature of the invention is the knowledge that MAX phase materials can be used for the resistive sheet. MAX phase materials have many good properties in the context, for instance they resist high temperatures.

MAX phase materials are materials that are defined by the formula $M_{n+1}AX_n$. In the formula, M stands for a transition metal in the group consisting of scandium (Sc), titanium (Ti), vanadium (V), chromium (Cr), zirconium (Zr), niobium (Nb), molybdenum (Mo), hafnium (Ht) and tantalum (Ta) or a combination of two or more transition metals from the group. A stands for elements in the group aluminium (Al), silicon (Si), phosphorus (P), sulphur (S), gallium (Ga), germanium (Ge), arsenic (As), cadmium (Cd), indium (In), tin (Sn), tallium (TI) and lead (Pb) or a combination of two or more elements in the group. X stands for carbon (C) and/or nitrogen (N).

In the formula for MAX phase materials, $M_{n+1}AX_n$, n can be either 1, 2 or 3, which results in three groups of materials. The first group with n=1 is called the 211 group. The figures stand for number of atoms of each chemical element M, A and X, respectively. Table 2 below contains all currently known materials in the 211 group. The second group has n=2 and is called the 312 group. Three materials are known in the group, $Ti_3GeC_2$, $Ti_3AlC_2$ and $Ti_3SiC_2$. The third group has n=3 and is called the 413 group. This contains only one currently known material $Ti_4AlN_3$.

TABLE 2

MAX phase material, 211 group

| | | | | | |
|---|---|---|---|---|---|
| $Ti_2AlC$ | $Ti_2AlN$ | $Hf_2PbC$ | $Cr_2GaC$ | $V_2AsC$ | $Ti_2InN$ |
| $Nb_2AlC$ | $(Nb, Ti)_2AlC$ | $Ti_2AlN_{1/2}C_{1/2}$ | $Nb_2GaC$ | $Nb_2AsC$ | $Zr_2InN$ |
| $Ti_2GeC$ | $Cr_2AlC$ | $Zr_2SC$ | $Mo_2GaC$ | $Ti_2CdC$ | $Hf_2InN$ |
| $Zr_2SnC$ | $Ta_2AlC$ | $Ti_2SC$ | $Ta_2GaC$ | $Sc_2InC$ | $Hf_2SnN$ |
| $Hf_2SnC$ | $V_2AlC$ | $Nb_2SC$ | $Ti_2GaN$ | $Ti_2InC$ | $Ti_2TlC$ |
| $Ti_2SnC$ | $V_2PC$ | $Hf_2SC$ | $Cr_2GaN$ | $Zr_2InC$ | $Zr_2TlC$ |
| $Nb_2SnC$ | $Nb_2PC$ | $Ti_2GaC$ | $V_2GaN$ | $Nb_2InC$ | $Hf_2TlC$ |
| $Zr_2PbC$ | $Ti_2PbC$ | $V_2GaC$ | $V_2GeC$ | $Hf_2InC$ | $Zr_2TlN$ |

MAX phase materials have a special crystal structure which combines the best properties of the metals with the advantages of the ceramics. They have high electrical and thermal conductivity, low friction, very high resistance to wear and resist temperature shocks. The materials can be made by sintering or by PVD, Physical Vapour Deposition.

Since MAX phase materials have high conductivity and can resist extremely high temperatures, they can be used as a thin resistive sheet in a microwave absorber at high temperatures, above 1000° C., but, of course, also at room temperature and temperatures therebetween.

Figure 2A:
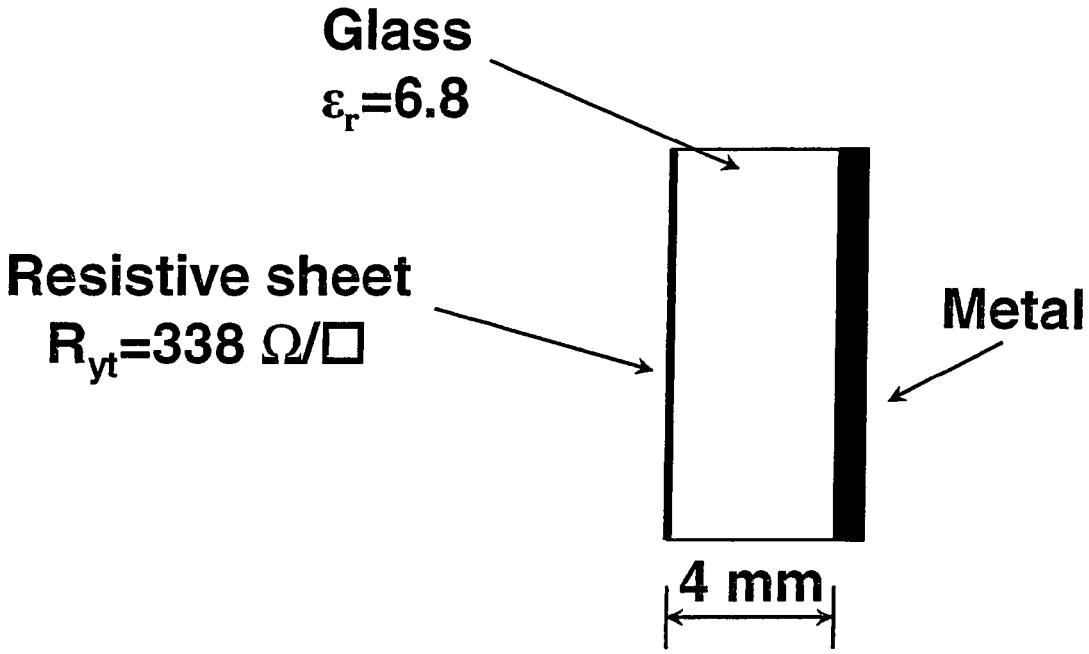
FIG. 2*a* illustrates a first test design of the invention.
Figure 3A:
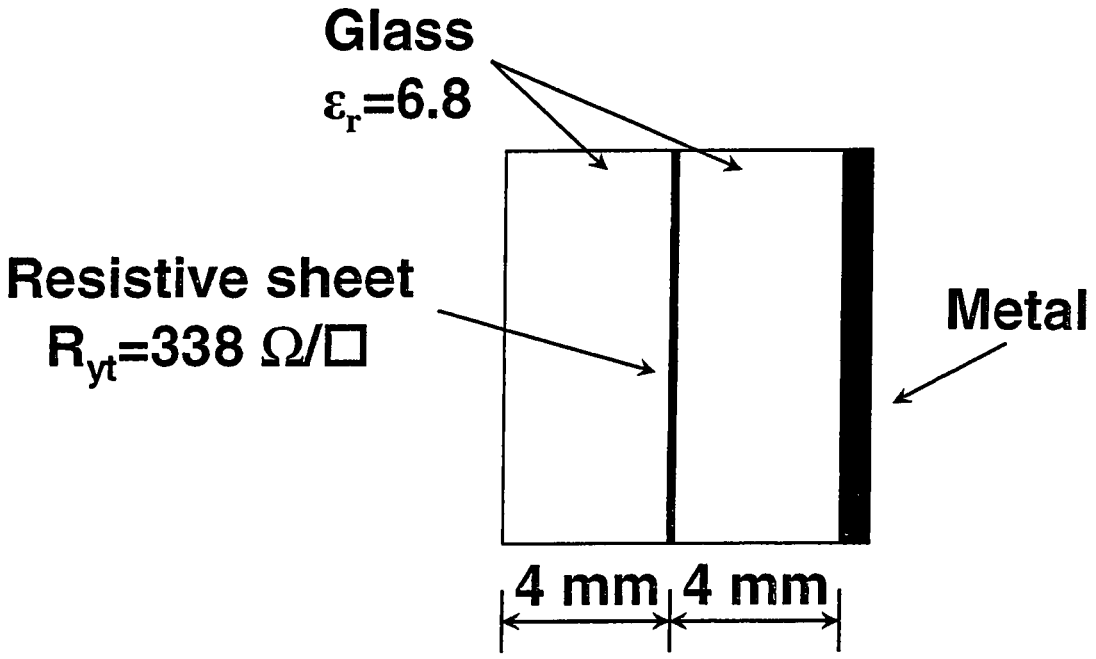
FIG. 3*a* illustrates a second test design of the invention.

In order to fundamentally determine that MAX phase materials can function as a thin resistive sheet in a radar absorbing layer structure, a few thin coatings of titanium silicon carbide $Ti_3SiC_2$ were produced on a glass substrate using PVD. MAX phase materials from the 312 group are highly convenient for use in the present invention. FIG. 2*a* illustrates a Salisbury screen-like layer structure with the resistive sheet made of $Ti_3SiC_2$ and FIG. 3*a* illustrates a single foil layer, likewise with the resistive sheet made of $Ti_3SiC_2$.

Figure 2B:
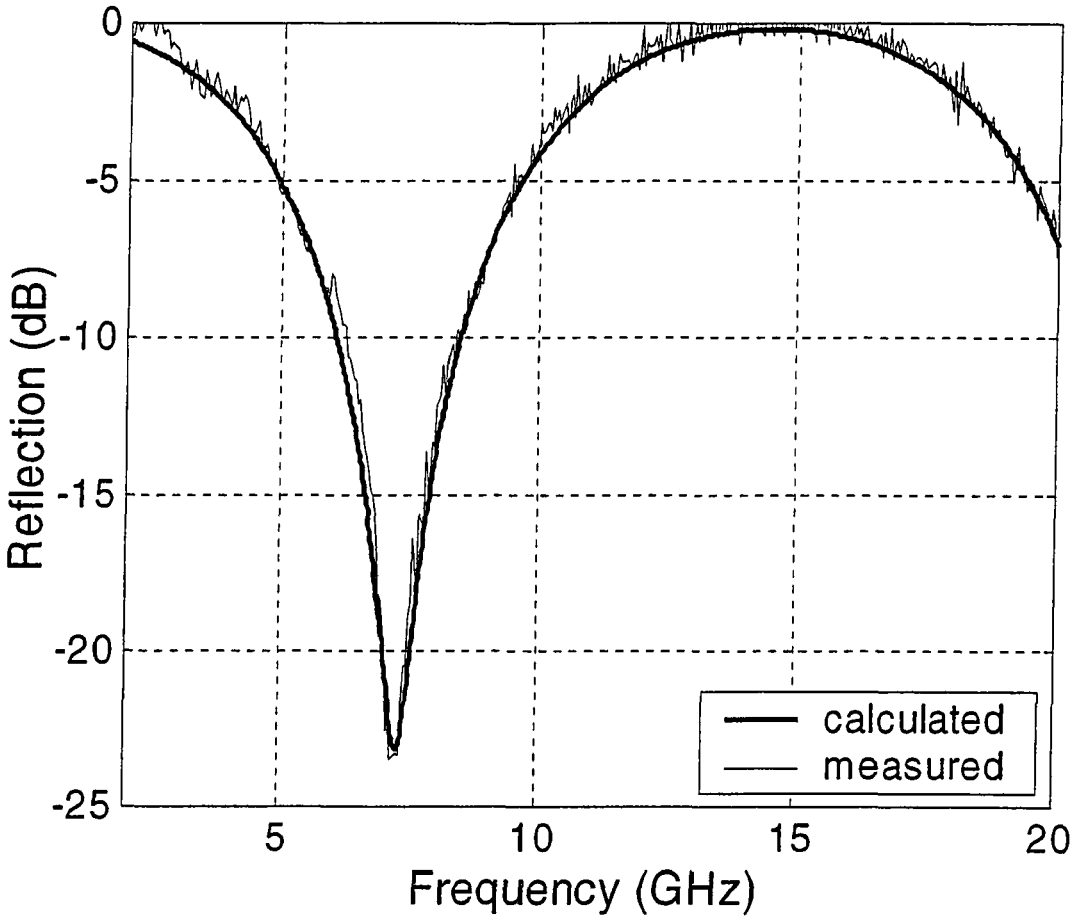
FIG. 2*b* is a diagram of the radar absorbing ability of the embodiment of the invention shown in FIG. 2*a*.
Figure 3B:
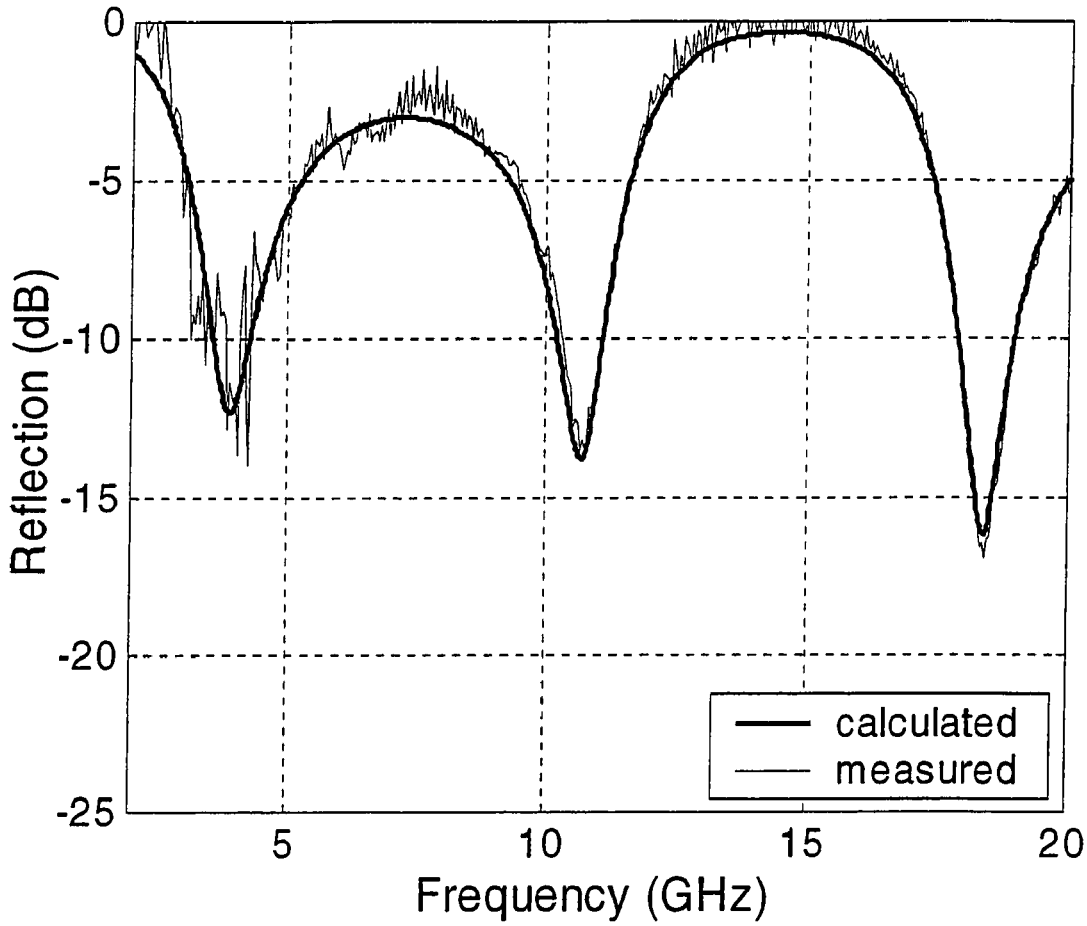
FIG. 3*b* is a diagram of the radar absorbing ability of the embodiment of the invention shown in FIG. 3*a*.

FIGS. 2*b* and 3*b* are diagrams of measured reflection from the respective radar absorbers in free space in the frequency range 2-20 GHz at room temperature and Theoretically calculated reflection of the same structures. The diagrams demonstrate that the measured reflection very well matches the theoretically calculated values. This means that a resistive sheet made of $Ti_3SiC_2$ well serves its purpose in the respective radiation absorbing layer structures.

It is important to emphasise that the created layer structures are used only to verify that MAX phase materials can be used for the purpose in question. None of the layer structures was optimised in any way, which is noticed from the fact that reflection minima in FIGS. 2*b* and 3*b* are narrowband and not optimal. If the surface resistance of the resistive sheet, the relative dielectric constant of the distance material and the thickness of different layers are optimised, a smaller reflection can be obtained for a broader frequency band. The conventional methods for optimising radiation absorbing layer structures can be used in the case in question and are well known to a person skilled in the art.

The surface resistance of the produced test coating of $Ti_3SiC_2$ was 338Ω/□ which is near the wave impedance of vacuum (=377Ω), which is advantageous for a Salisbury screen. The surface resistance of the sheet can be changed by choosing a suitable material, for instance another MAX phase material with different conductivity σ and/or choosing the thickness d of the sheet, since $R_{yt}=1/\sigma d$.

In order to determine that MAX phase materials can function also at high temperatures as a thin resistive sheet in a radar absorber, a Salisbury screen-like sample was produced with quartz glass $SiO_2$ as a substrate, which resists higher temperatures. In the same way as in the above-mentioned room temperature example, a thin coating of $Ti_3SiC_2$ was applied to the quartz glass substrate using PVD. Measurements performed on the sample demonstrate a good function with a distinct reflection minimum at least up to 200° C.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A microwave absorber, especially for high temperature applications, comprising at least one electrically resistive sheet and at least one dielectric layer, the electrically resistive sheet having a material of construction of a MAX phase material and the dielectric layer having a material of construction of a material that resists high temperatures.

2. The microwave absorber as claimed in claim 1, wherein the MAX phase material is a 312 group material.

3. The microwave absorber as claimed in claim 2, wherein the 312 group material is a titanium silicon carbide, $Ti_3SiC_2$.

4. The microwave absorber as claimed in claim 1, wherein the dielectric layer is a low permittivity ceramic or a ceramic composite.

5. The microwave absorber as claimed in claim 4, wherein the ceramic includes pores therein so as to lower a dielectric constant thereof to a desirable level.

6. The microwave absorber as claimed in claim 2, wherein the dielectric layer is a low permittivity ceramic or a ceramic composite.

7. The microwave absorber as claimed in claim 3, wherein the dielectric layer is a low permittivity ceramic or a ceramic composite.

8. A microwave absorber for high temperature applications, comprising at least one electrically resistive layer and at least one dielectric layer, the electrically resistive layer having a material of construction of a MAX phase material, and the dielectric layer having a material of construction of a material that resists high temperatures, the absorber being configured to create a negative interference between radiation that has penetrated to an underlying metal layer and radiation that reflects from the resistive layer, so as to diminish the reflection of radiation from the metal layer.

9. The microwave absorber according to claim 8, wherein the MAX phase material is a 312 group material and the dielectric layer is a low permittivity ceramic or a ceramic composite.

10. The microwave absorber according to claim 9, wherein the 312 group material is a titanium silicon carbide, $Ti_3SiC_2$.

* * * * *